US006959464B2

(12) United States Patent
Fahey

(10) Patent No.: US 6,959,464 B2
(45) Date of Patent: Nov. 1, 2005

(54) PREGNANCY AIR MATTRESS/RAFT

(76) Inventor: Kim A. Fahey, 77 French Ave., Braintree, MA (US) 02184

( * ) Notice: Subject to any disclaimer, the term of this patent is extended or adjusted under 35 U.S.C. 154(b) by 0 days.

(21) Appl. No.: 11/065,027

(22) Filed: Feb. 25, 2005

(65) Prior Publication Data

US 2005/0188465 A1 Sep. 1, 2005

Related U.S. Application Data

(60) Provisional application No. 60/548,176, filed on Mar. 1, 2004.

(51) Int. Cl.[7] ..... A47C 27/10
(52) U.S. Cl. ..... 5/735; 5/710; 5/930
(58) Field of Search ..... 5/735, 731, 631, 5/632, 930, 706, 710

(56) References Cited

U.S. PATENT DOCUMENTS

| | | | | | |
|---|---|---|---|---|---|
| 3,988,793 | A | * | 11/1976 | Abitbol | 601/11 |
| 4,054,960 | A | | 10/1977 | Pettit et al. | 5/631 |
| 4,737,999 | A | * | 4/1988 | Halverson | 5/710 |
| 4,819,287 | A | * | 4/1989 | Halverson | 5/710 |
| 5,237,712 | A | | 8/1993 | Ramsey | 5/710 |
| 5,400,449 | A | | 3/1995 | Satto | 5/631 |
| 5,412,824 | A | | 5/1995 | Emerson et al. | 5/632 |
| 5,425,147 | A | | 6/1995 | Supplee et al. | 5/713 |
| 5,652,981 | A | | 8/1997 | Singer-Leyton et al. | |
| 5,679,040 | A | * | 10/1997 | Bianchi-Holm | 441/129 |
| D392,145 | S | | 3/1998 | Thurston | D6/604 |
| 5,819,348 | A | * | 10/1998 | Ryan | 5/735 |
| 5,826,287 | A | | 10/1998 | Tandrup | 5/655 |
| D403,194 | S | | 12/1998 | Thurston | D6/604 |
| 6,233,768 | B1 | * | 5/2001 | Harding | 5/735 |
| 6,568,015 | B1 | | 5/2003 | Allen | 5/735 |

* cited by examiner

*Primary Examiner*—Robert G. Santos
(74) *Attorney, Agent, or Firm*—Richard C. Litman

(57) ABSTRACT

A pregnancy air mattress/raft is inflatable which is useful for floating in water or sunning on the beach. The air mattress is inflatable and deflatable and is adjusted by adjusting air pressure. The mattress has a rectangular cavity reaching through the mattress, allowing the pregnant torso to bathe in the water when used as a raft. The cavity is elongated to receive the breasts of the user in a prone position. Removably attached side bolsters are mounted on each side of the rectangular cavity by engaging hook and loop material (Velcro) strips and may be adjusted in air pressure for needed support throughout the pregnancy. The side bolsters may be totally removed during the latter stages of pregnancy. An elongated, face-receiving cavity is provided having an air tunnel leading to the front of the air mattress. An ankle bolster is provided useful as an additional pillow.

20 Claims, 6 Drawing Sheets

PREGNANCY AIR MATTRESS/RAFT

CROSS-REFERENCE TO RELATED APPLICATION

This application claims the benefit of U.S. Provisional Patent Application Ser. No. 60/548,176, filed Mar. 1, 2004.

BACKGROUND OF THE INVENTION

1. Field of the Invention

The present invention relates to inflatable mattresses. More particularly, the present invention relates to inflatable mattresses for supporting a pregnant woman, useful for floating on water or lying on a beach, and used at home as a secondary bed.

2. Description of the Related Art

The comfortable support of pregnant women when lying in a prone position has long been a problem. The problem is exacerbated by the natural progression of torso shape during the pregnancy. Existing mattresses provide a recess for the enlarged portion of the torso when the woman is lying in a prone position and provide a variety of configurations for adjustment during the pregnancy. It would be desirable to provide an inflatable mattress for pregnant women which is useful for floating in water or resting on land, such as at the beach, which adjustably provides a cavity for the abdomen and breasts of the user in a simple structure while providing adjustable side support to the abdomen.

U.S. Des. 392,145, issued Mar. 17, 1998, to Thurston depicts an air mattress having removable portions to accommodate the user's breasts and abdomen when lying in a prone position thereon and having a face-receiving breathing tunnel having an upper cross piece and an adjustable ankle bolster.

U.S. Des. 403,194, issued Dec. 29, 1998, to Thurston depicts an air mattress having an elevated abdomen receiver having graduated adjustment pads and a face receiver having a breathing tunnel integrated into the air mattress.

U.S. Pat. No. 4,054,960, issued Oct. 25, 1977, to Pettit et al., describes an inflatable cushion which is foldable and has an upward opening breathing channel.

U.S. Pat. No. 5,237,712, issued Aug. 24, 1993, to Ramsay, describes a maternity mattress with an abdomen receiving portion having a series of interfitting inflatable inserts for adjusting the size of the receiving portion, the inflatable inserts being adjustably inflated for further adjustment to fit the abdomen.

U.S. Pat. No. 5,400,449, issued Mar. 28, 1995, to Satto, describes a prone pregnancy cushion or mattress having removable segments adjusting for pregnancy where a breast receiver communicates directly with the abdomen receiver.

U.S. Pat. No. 5,412,824, issued May 9, 1995, to Emerson et al. describes a pregnancy support mattress having a removable freestanding ankle bolster.

U.S. Pat. No. 5,425,147, issued Jun. 20, 1995, to Supplee et al., describes an adjustable air cushion maternity mattress.

U.S. Pat. No. 5,652,981, issued Aug. 5, 1997, to Singer-Leyton et al., describes a massage cushion for maternity use having a cavity which encompasses both the breasts and the abdomen.

U.S. Pat. No. 5,826,287, issued Oct. 27, 1998, to Tandrup, describes an infant support system having removable side bolsters.

U.S. Pat. No. 6,568,015 B1, issued May 27, 2003, to Allen describes a mattress for supporting a pregnant woman or other individual having abdominal problems which is provided with a structure having attachable straps and which is useful for changing a person from a prone position to a supine position having an inflatable abdominal cavity.

None of the above inventions and patents, taken either singly or in combination, is seen to describe the instant invention as claimed. Thus a pregnancy air mattress/raft solving the aforementioned problems is desired.

SUMMARY OF THE INVENTION

The pregnancy air mattress/raft or float of the present invention is inflatable and of a vinyl or other plastic sheet material which is conducive to use for floating in water or sunning on the beach, however, it is useful in any environment. The air mattress is inflatable and deflatable and is adjustable in support by adjusting the air pressure. The air mattress has a rectangular cavity reaching through the mattress, allowing the abdomen to bathe in the water when used as a raft. The cavity is elongated to receive the breasts of the pregnant woman while in a prone position.

Removably attached side bolsters are mounted on each side of the rectangular cavity, preferably by interacting hook and loop material (Velcro) strips and may be adjusted in air pressure to provide comfortable side support to the pregnant woman during the progression of the pregnancy. The side bolsters may be totally removed during the latter stages of pregnancy, depending on the size of the individual. An elongated face-receiving cavity is provided having an air tunnel leading to the front of the air mattress. A separate ankle bolster is provided which may also be used as an additional pillow.

It is an aspect of the invention to provide improved elements and arrangements thereof for the purposes described which is inexpensive, dependable and fully effective in accomplishing its intended purposes.

These and other aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
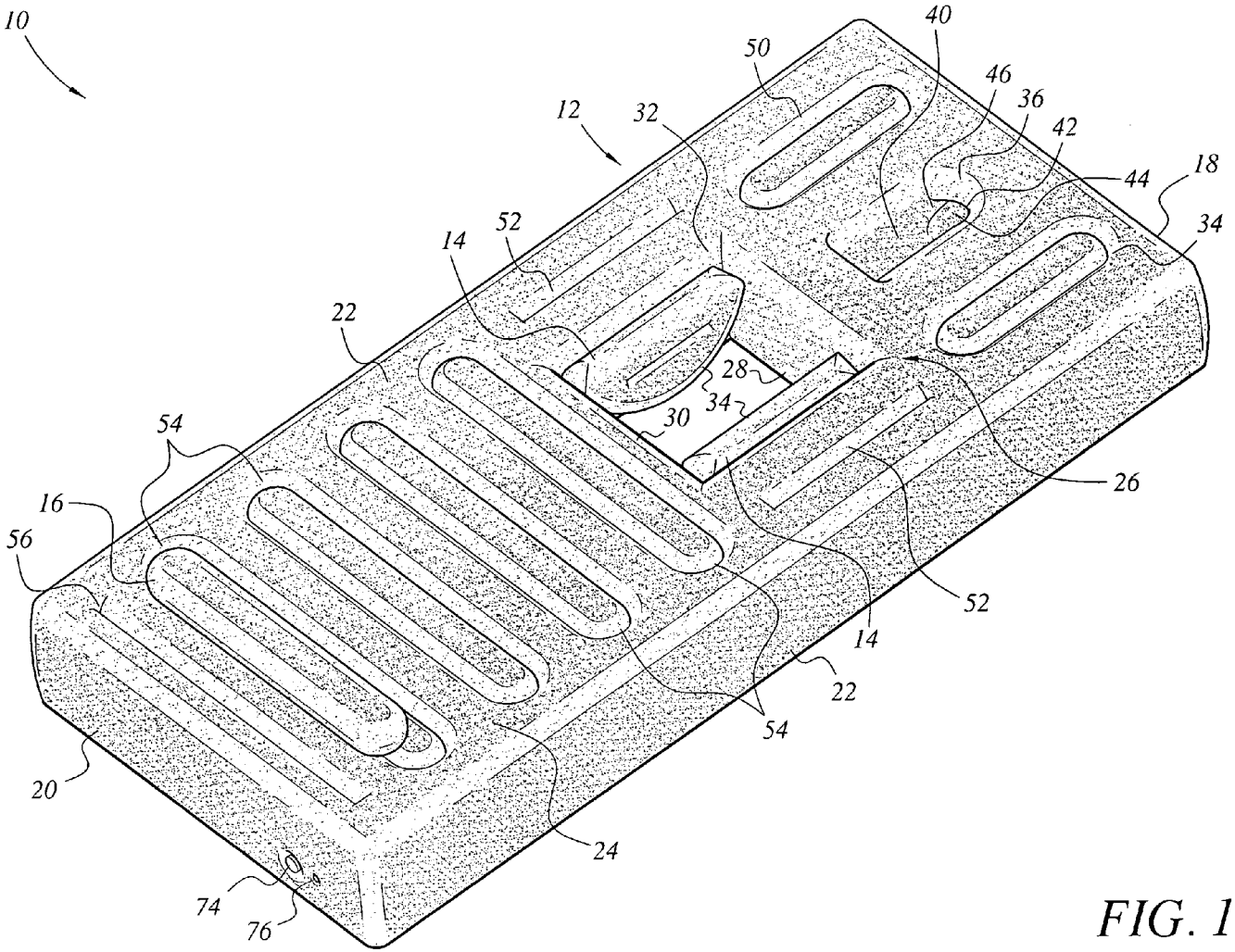
FIG. 1 is an environmental, perspective view of a pregnancy air mattress and raft according to the present invention.
Figure 2:
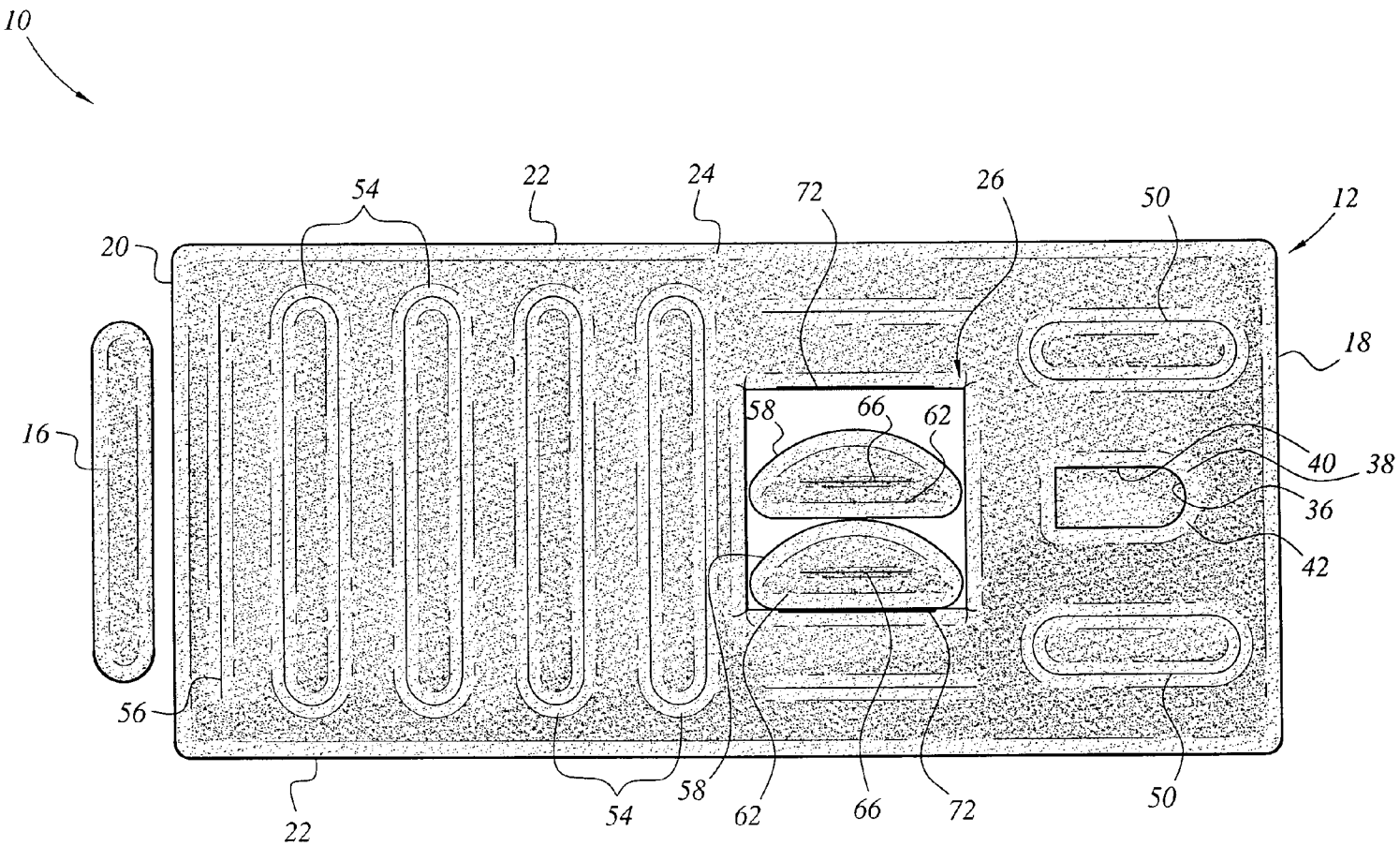
FIG. 2 is a plan view of the mattress and raft of FIG. 1 with the side bolsters removed from attachment and placed free within the rectangular cavity for support for use on the beach or other flat surface.
Figure 3:
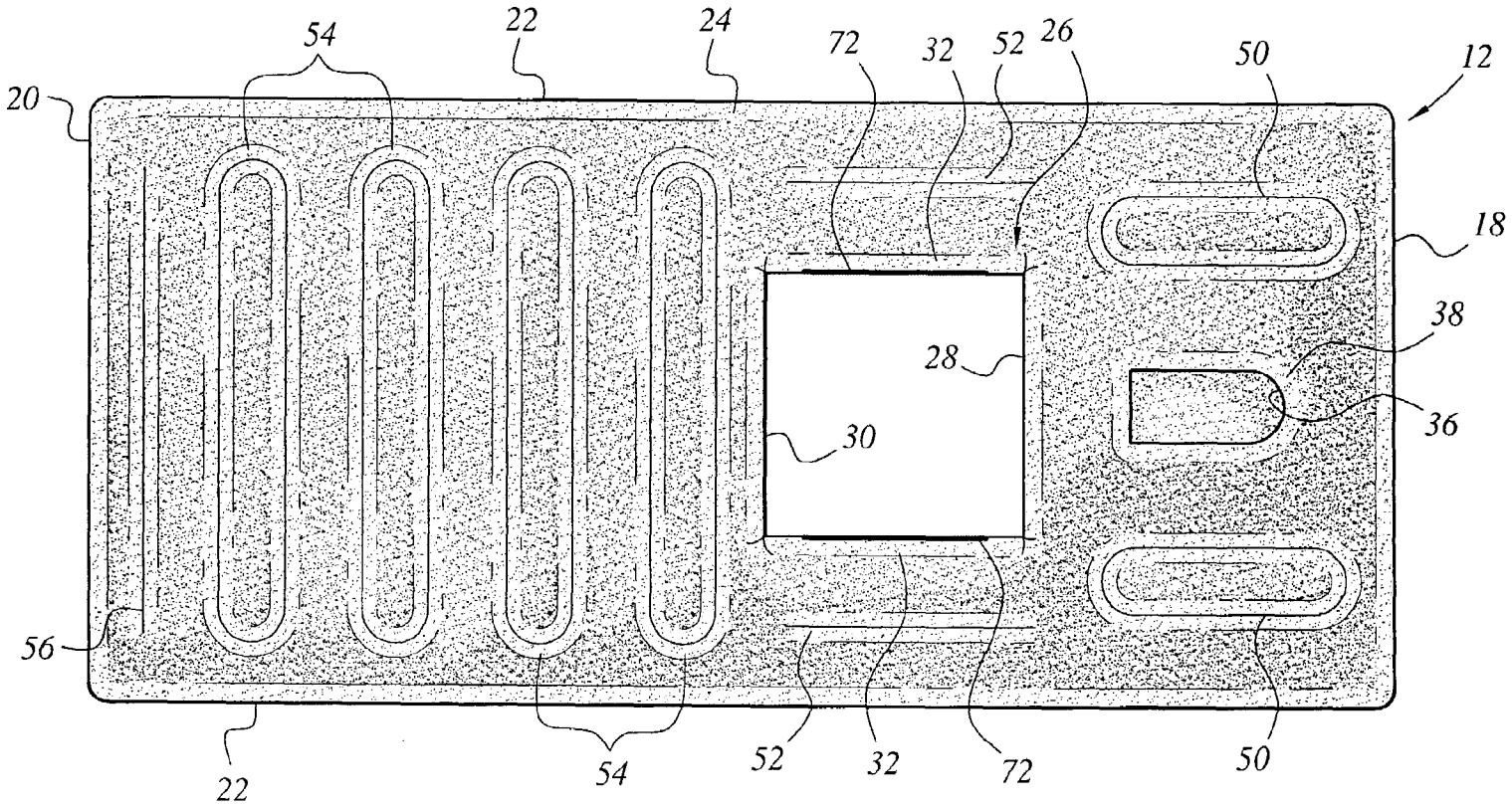
FIG. 3 is a plan view of the mattress and raft of FIG. 1 with the bolsters removed for use by a woman late ir pregnancy.

The present invention is a pregnancy air mattress/raft which is inflatable and of a vinyl or other plastic sheet material which is conducive to use for floating in water or sunning on the beach, however, it is useful in any environment. The air mattress is inflatable and deflatable and is adjustable in support by adjusting the air pressure. The air mattress has a rectangular cavity reaching through the mattress, allowing the abdomen to bathe in the water when used as a raft. The cavity is elongated to receive the breasts of the pregnant woman while in a prone position. Removably attached side bolsters are mounted on each side of the rectangular cavity, preferably by interacting hook and loop material (Velcro) strips and may be adjusted in air pressure to provide comfortable side support to the pregnant woman during the progression of the pregnancy.

Referring to the Figures, pregnancy air mattress/raft system 10 includes an inflatable mattress 12 shown as rectangular, and having inflatable side bolsters 14 attached thereto and a free standing ankle bolster or pillow 16. Mattress 10 has a head end 18, a foot end 20 and sides 22. Mattress 12 has lower wall (not specifically shown) and a pleated upper surface 24 and defines an open rectangular torso cavity 26 forward of the center of the mattress extending downward, vertically through the mattress 12. Torso cavity 26 has a head wall 28, a foot wall 30, and sidewalls 32, forming the cavity 26.

Figure 4:
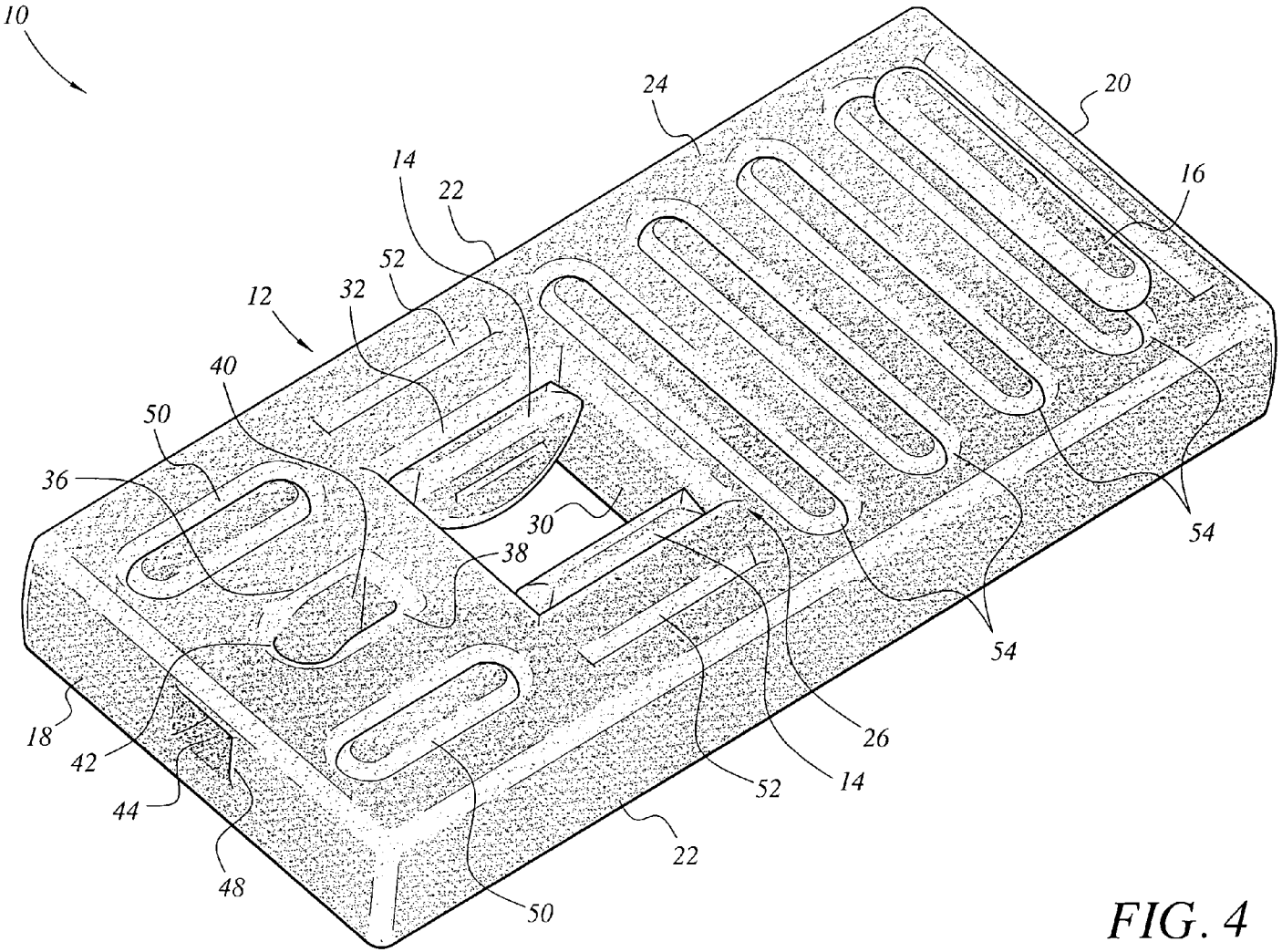
FIG. 4 is a front perspective view of the mattress and raft of FIG. 1, with the side bolsters installed on the cavity upper walls.
Figure 5:
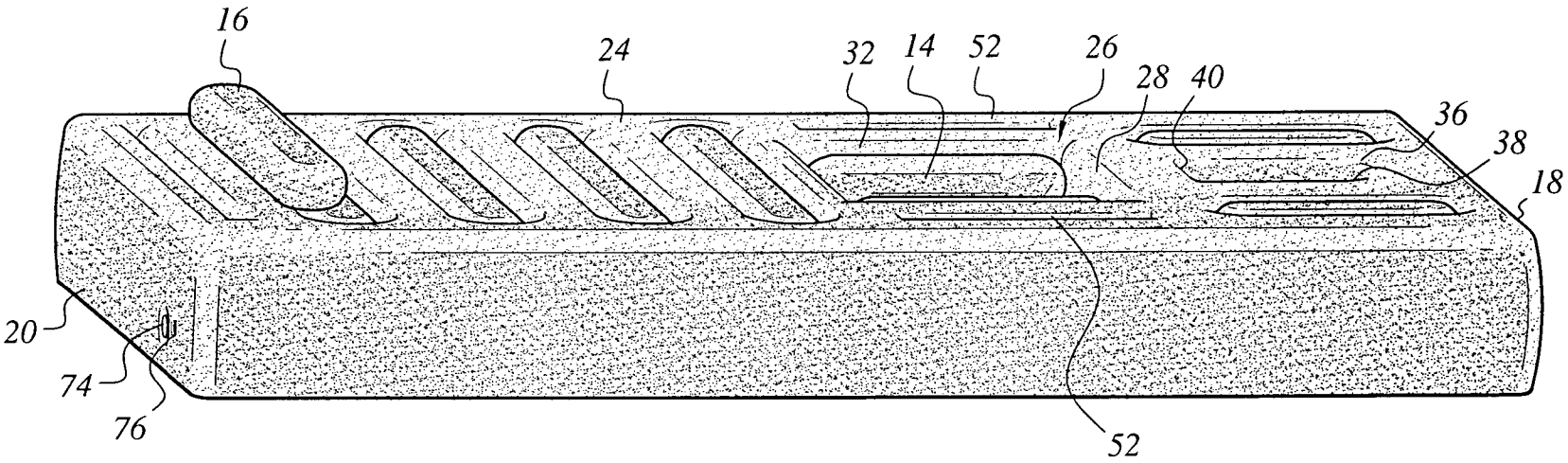
FIG. 5 is a shallow side perspective view of the mattress and raft of FIG. 1.

Matching cavity sidewall bolsters 14 are mounted along the upper portions of sidewalls 32 of torso cavity 28 by hook material strips 68 on bolsters 14 (see FIG. 6) attaching to mutually engaging longitudinal loop material strips 72 positioned along respective upper sidewalls 32. The hook and loop material (Velcro) strips may be reversed as desired such that the hook material strips 68 are placed on the torso cavity sidewalls 32 and the loop material strips 72 may be placed on the side bolsters 14. Due to the natural convex shape of the sidewalls 32 when mattress 12 is inflated, the sidewall bolsters, as attached, flare outwardly and upwardly from the center of cavity 28 so as to form a wedge shape. Face cavity 36 is formed in the head portion of the mattress, through upper surface 24, and is defined by face cavity rim 38. Rim 38 defines a rectangular portion 40 and a forehead rest portion 42 and is in fluid connection with breathing tunnel 44 (see FIG. 4) at face end 46, tunnel 44 having a forward end opening 48 in mattress head end 18.

During the advanced stage of pregnancy, the user may remove the side bolsters 14, the sidewalls 32 providing adequate side support to the pregnant torso of a woman user. Due to the elasticity of the inflated mattress/raft system the sidewalls of the torso cavity, with or without the side bolsters attached will adjust to the shape of the pregnant torso.

Upper surface 24 has creases defined in the surface so as to provide a bulged frame around the torso cavity 28, the neck area and the face cavity 36 for added comfort and to provide a nest for the foot bolster 16. This is accomplished by providing upper creases 50 spaced outward from and extending along face cavity 36, side creases 52, spaced outward from torso cavity 26 and crosswise lower creases 54 and foot end crease 56, providing a series of nesting places for ankle bolster 16, as well as maintaining the surface 24 in, a relatively flat configuration.

Figure 6:
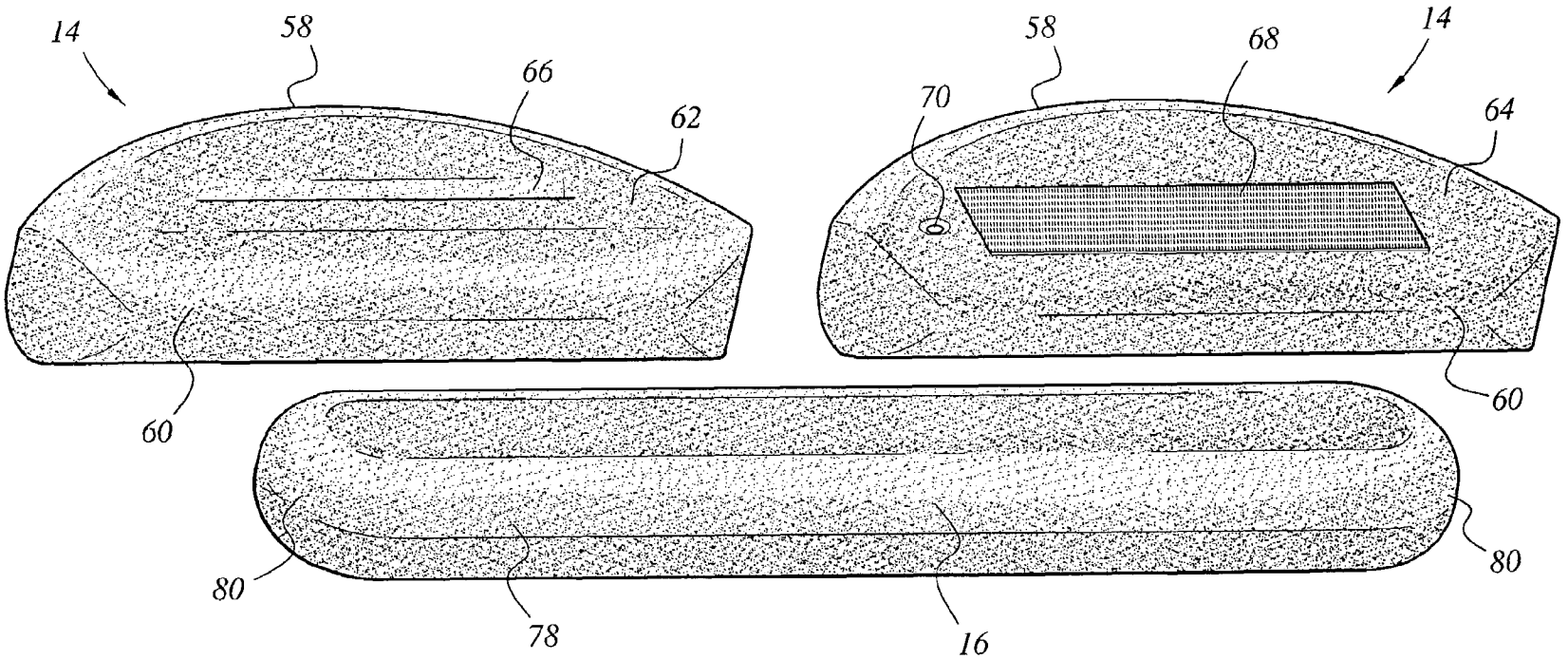
FIG. 6 is a detail view of the side bolsters and ankle bolster of FIG. 1.

Referring to FIG. 6, bolsters 14 are generally semicircular in shape, formed by a lower curved wall 58 and an upper straight wall 60 as mounted along sidewalls 32 of torso cavity 26. Bolsters 14 each have an inner side 62 and an opposite attachment side 64, inner side 62 having a lengthwise crease 66 and attachment side 64 having a longitudinal bolster hook material strip 68 attached thereto. A bolster inflation valve 70 is located on attachment side 64 for adjustable inflation by a well-known air pump (not shown). Ankle bolster or pillow 16 has an elongate, cylindrical body 78 and hemispherical end portions 80 and is preferably inflatable (valve not shown). The ankle bolster 16 is free to be placed anywhere on the mattress 12, and may be used as a pillow for the head as desired.

As seen in FIG. 1, mattress 12 has a deflation valve 74 and an inflation valve 76 at foot end 20.

In use, the mattress/raft 12 is inflated to the desired pressure or configuration. The side bolsters 14 are then inflated to the desired pressure so as to provide the needed space and support to the torso of the pregnant woman to be using the mattress/raft 12. The side bolsters are then attached to the sidewalls 32 of the torso cavity 26 by means of the mutually engaging hook and loop material strips 68 and 72, respectfully. The ankle bolster 16 is inflated for use. The mattress/raft 12 may then be launched in the water and the pregnant woman assumes a prone position with her breasts and pregnant torso within the rectangular torso cavity 26. The wedge shape formed by the side bolsters 14 allows the pregnant torso to comfortably fit and be supported along the sides of the torso cavity 26.

For some women it may be more comfortable to rest her breasts on the area forward of torso cavity 26. During an advanced state of pregnancy, the torso cavity 26 may be used without the inflatable side bolsters. In this case, the inflated raft walls will assume a supporting shape due to the weight of the pregnant torso. The face of the user is placed in the face cavity 36 along the face cavity rim 38 at the forehead rest portion 42, allowing breathing through tunnel 44. The ankle bolster 16 may be adjusted to support the ankles of the user when desired along the upper surface of the foot portion of mattress pleated upper surface 24.

As described above, the mattress/raft of the present invention allows a pregnant woman to enjoy floating on water such as in a pool or lake and allow water to reach the pregnant torso adding comfort for the user by coolness and buoyancy of the water. The mattress system 12 may also be used on land, such as a beach, and the user has the option of removing side bolsters 14 and placing them on the land surface so as to support and protect the pregnant torso from contact with the land surface.

The components of the pregnancy mattress/raft system of the present invention may be made of any appropriate materials. One preferred material vinyl sheeting which is formed into the appropriate shape by heat welding and/or adhesive. The mattress/raft or float is preferably about 6' long by 31" wide. The torso cavity is about 16.5" long by 18" wide.

It is to be understood that the present invention is not limited to the embodiment described above, but encompasses any and all embodiments within the scope of the following claims.

I claim:

1. A pregnancy air mattress/raft comprising:

an air inflatable mattress/raft having a head end, a foot end, sides, an upper surface, and a lower wall and having an air inlet and an air outlet for adjusting the air pressure within said mattress/raft;

said air inflatable mattress/raft defining a generally rectangular torso cavity extending through the raft having a head wall, a foot wall, and opposing sidewalls, said rectangular torso cavity being generally centrally located relative to said sides and forward of the lengthwise center of the mattress/raft so positioned as to receive the pregnant torso of a woman in a prone position on the mattress/raft; and a pair of air inflatable side bolsters removably attachable along said opposing sidewalls of said torso cavity so mounted as to form a generally wedge shaped opening in said torso cavity for side support of the pregnant torso.

2. The air mattress/raft of claim 1, wherein said air inflatable mattress defines a face cavity centrally located and spaced forward of said torso cavity and a horizontal breathing tunnel extending forward from said face cavity through said mattress head end for allowing the prone user to breathe while in a prone position.

3. The air mattress/raft of claim 2, wherein said face cavity is defined by a forward curved rim and a rectangular portion, said forward curved rim forming a forehead rest portion.

4. The air mattress/raft of claim 3, wherein said breathing tunnel extends from below said forehead rest portion to said mattress head end.

5. The air mattress/raft of claim 1, said side bolsters and said torso cavity sidewalls having longitudinal mutually engaging hook and loop material strips, said side bolters being removably attached to said torso cavity sidewalls thereby.

6. The air mattress/raft of claim 5, each of said bolsters being separately inflatable and having a lower convex generally semicircular, curved wall, an upper straight wall, an inner sidewall relative to said torso cavity and an attachment sidewall having one of a hook and a loop material strip for attachment to said torso cavity sidewalls.

7. The air mattress/raft of claim 1, further comprising a generally cylindrical ankle bolster, said upper surface of said air mattress defining at least one crosswise lower crease located between said foot end and said torso cavity foot wall for receiving said ankle bolster.

8. The air mattress/raft of claim 7, said at least one crosswise lower crease comprising a plurality of creases.

9. The air mattress/raft of claim 8, said upper surface defining at least one longitudinal crease on each side of said face cavity for receiving said ankle bolster.

10. A pregnancy air mattress/raft comprising:

an air inflatable mattress/raft having a head end, a foot end, sides, an upper surface, and a lower wall and having an air inlet and an air outlet for adjusting the air pressure within said mattress/raft;

said air inflatable mattress/raft defining a generally rectangular torso cavity extending through the raft having a head wall, a foot wall, and opposing sidewalls, said rectangular torso cavity being generally centrally located relative to said sides and forward of the lengthwise center of the mattress/raft so positioned as to receive the pregnant torso of a woman in a prone position on the mattress/raft;

said air inflatable mattress defining a face cavity centrally located and spaced forward of said torso cavity and a horizontal breathing tunnel extending forward from said face cavity through said mattress head end for allowing the prone user to breathe while in a prone position; and a pair of air inflatable side bolsters removably attachable along said opposing sidewalls of said torso cavity so mounted as to form a generally wedge shaped opening in said torso cavity for side support of the pregnant torso.

11. The air mattress/raft of claim 10, wherein said face cavity is defined by a forward curved rim and a rectangular portion, said forward curved rim forming a forehead rest portion.

12. The air mattress/raft of claim 11, wherein said breathing tunnel extends from below said forehead rest portion to said mattress head end.

13. The air mattress/raft of claim 10, said side bolsters and said torso cavity sidewalls having longitudinal mutually engaging hook and loop material strips, said side bolters being removably attached to said torso cavity sidewalls thereby.

14. The air mattress/raft of claim 13, each of said bolsters being separately inflatable and having a lower convex generally semicircular, curved wall, an upper straight wall, an inner sidewall relative to said torso cavity and an attachment sidewall having one of a hook and a loop material strip for attachment to said torso cavity sidewalls.

15. The air mattress/raft of claim 10, further comprising a generally cylindrical ankle bolster, said upper surface of said air mattress defining at least one crosswise lower crease located between said foot end and said torso cavity foot wall for receiving said ankle bolster.

16. The air mattress/raft of claim 15, said at least one crosswise lower crease comprising a plurality of creases.

17. The air mattress/raft of claim 16, said upper surface defining at least one longitudinal crease on each side of said face cavity for receiving said ankle bolster.

18. A pregnancy air mattress/raft comprising:

an air inflatable mattress/raft having a head end, a foot end, sides, an upper surface, and a lower wall and having an air inlet and an air outlet for adjusting the air pressure within said mattress/raft;

said air inflatable mattress/raft defining a generally rectangular torso cavity extending through the raft having a head wall, a foot wall, and opposing sidewalls, said rectangular torso cavity being generally centrally located relative to said sides and forward of the lengthwise center of the mattress/raft so positioned as to receive the pregnant torso of a woman in a prone position on the mattress/raft; and a pair of air inflatable side bolsters removably attachable along said opposing sidewalls of said torso cavity so mounted as to form a generally wedge shaped opening in said torso cavity for side support of the pregnant torso;

said side bolsters and said torso cavity sidewalls having longitudinal mutually engaging hook and loop material strips, said side bolters being removably attached to said torso cavity sidewalls thereby.

19. The air mattress/raft of claim 18, said air inflatable mattress defining a face cavity centrally located and spaced forward of said torso cavity and a horizontal breathing tunnel extending forward from said face cavity through said mattress head end for allowing the prone user to breathe while in a prone position.

20. The air mattress/raft of claim 18, further comprising a generally cylindrical ankle bolster, said upper surface of said air mattress defining at least one crosswise lower crease located between said foot end and said torso cavity foot wall for receiving said ankle bolster.

* * * * *